United States Patent [19]

Lucas

[11] Patent Number: 4,523,397

[45] Date of Patent: Jun. 18, 1985

[54] HIGH STRENGTH BUCKET

[75] Inventor: Victor A. Lucas, Yorkville, Ill.

[73] Assignee: Caterpillar Tractor Co., Peoria, Ill.

[21] Appl. No.: 574,794

[22] Filed: Jan. 27, 1984

[51] Int. Cl.[3] ..... E02F 3/70

[52] U.S. Cl. ..... 37/118 R; 414/722

[58] Field of Search ..... 37/118 R, 118 A, 117.5; 414/722, 723, 697

[56] References Cited

U.S. PATENT DOCUMENTS

| | | | |
|---|---|---|---|
| Re. 29,603 | 4/1978 | Oke et al. | 214/145 |
| T981001 | 4/1979 | McReynolds | 37/118 |
| 3,672,521 | 6/1972 | Bauer et al. | 414/723 |
| 3,845,870 | 11/1974 | Balderson et al. | 414/697 X |
| 3,860,131 | 1/1975 | Borowski | 214/145 |
| 3,913,768 | 10/1975 | Grooss | 214/774 |
| 3,975,844 | 8/1976 | Olson | 414/722 X |
| 4,086,712 | 5/1978 | McReynolds | 37/118 |
| 4,154,349 | 5/1979 | Christensen | 414/720 |
| 4,395,193 | 7/1983 | Christensen et al. | 414/722 |

*Primary Examiner*—Clifford D. Crowder
*Attorney, Agent, or Firm*—Claude F. White

[57] ABSTRACT

An earthmoving bucket for use with various types of wheel and track-type earthworking and construction machines is constructed to provide great strength and rigidity while at the same time not being unduly bulky or heavy. The bucket is further characterized by simplified manufacturability and cost advantages. Previous earthmoving buckets, which required considerable strength and durability, were quite heavy and bulky, with respect to bucket size, and required complicated, costly, and time-consuming assembly procedures. The earthmoving bucket of the present invention utilizes a pair of unitary cast lift hinge brackets which incorporates the pin bores for the lift linkage, the rack-back stops, and the bucket dump stops.

9 Claims, 4 Drawing Figures

HIGH STRENGTH BUCKET

DESCRIPTION

1. Technical Field

This invention relates generally to earthmoving buckets and more particularly to a high strength bucket for use with wheel and track-type construction and earthworking machines.

2. Background Art

Wheel and track-type loading vehicles are equipped with a bucket assembly, generally on the front of the vehicle, for loading and transporting various materials. These loading vehicles are often used in mining operations, road construction, and general earthmoving operations, as well as general stockpiling. The buckets are subjected to severe wear, fatigue, and impact strains and stresses. Constant loading and unloading causes severe shock loads to be imposed on the bucket structure through the rack-back stops and the dump-limit stops.

One type of bucket construction having various types of reinforcing means is disclosed in U.S. Pat. No. 4,086,712, issued to C. P. McReynolds on May 2, 1978. In this patent, a plurality of ribs and plates are joined together in overlapping fashion to define a box section. The box section is intended to reinforce a relatively thin-walled bucket shell. Although this patent provides effective reinforcing for a bucket, such reinforcing includes a plurality of ribs and plates which require considerable time and effort in positioning and connecting such members together. Also, the manipulating brackets for connecting the bucket to a vehicle are constructed of a plurality of plates and ribs which must also be located and joined together in a time-consuming manner.

Another bucket reinforcing structure is disclosed in U.S. Pat. No. Re. 29,603, issued to S. A. Oke et al. on May 2, 1978. As in the above-noted McReynolds patent, various cooperating rib and plate means are provided for defining a reinforcement box section. The problems associated with this construction are very similar to those of the McReynolds patent in that a considerable number of plates and ribs must be precisely located and held in position for joining together. Also, as in the McReynolds patents, the bracket structure for connecting the bucket to a vehicle is constructed of a plurality of plate members.

The present invention is directed to overcoming one or more of the problems as set forth above.

Disclosure of the Invention

In one aspect of the present invention, an earthmoving bucket has first and second end walls, a shell portion, which includes a bottom wall portion and a rear wall portion, and extends laterally between the end walls. The bucket includes a cutting edge support, secured to a forward edge of the bottom wall portion, and first and second reinforcing beam assemblies. The bucket further includes first, second, and third bracket assemblies, with the second and third bracket assemblies being connected to the second reinforcing beam as well as to the rear wall portion of the bucket.

Earthmoving buckets for use with construction and earthworking vehicles must possess considerable strength and rigidity and yet not be unduly heavy or bulky to limit the working capacity of the bucket or vehicle. During working cycles of the vehicle, the bucket is subjected to severe strains and stresses, including shock impacting loads imposed when the bucket is loaded and unloaded. The life of the bucket is extended by advantageous placement of reinforcing assemblies and by high strength brackets which connect the bucket to the vehicle. A pair of bucket lifting brackets are each formed of a single unitary cast member and include the rack-back and dump stops.

Best Mode For Carrying Out the Invention

Figure 1:
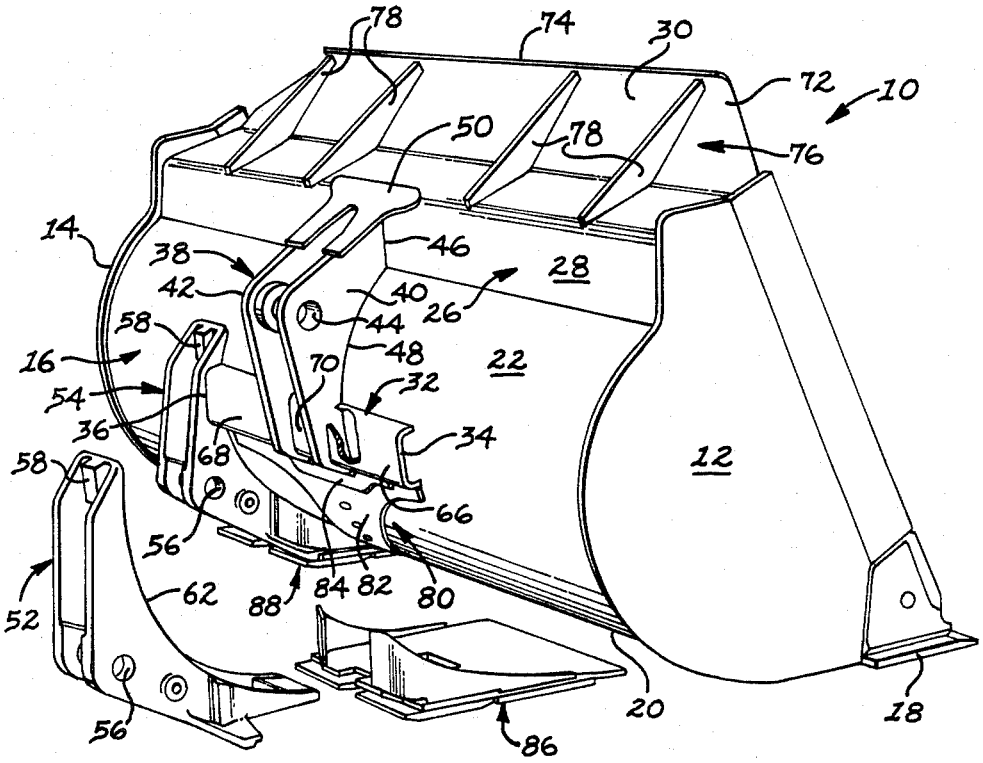
FIG. 1 is a diagrammatic perspective rear view of the earthmoving bucket of the present invention with certain parts shown disconnected.
Figure 3:
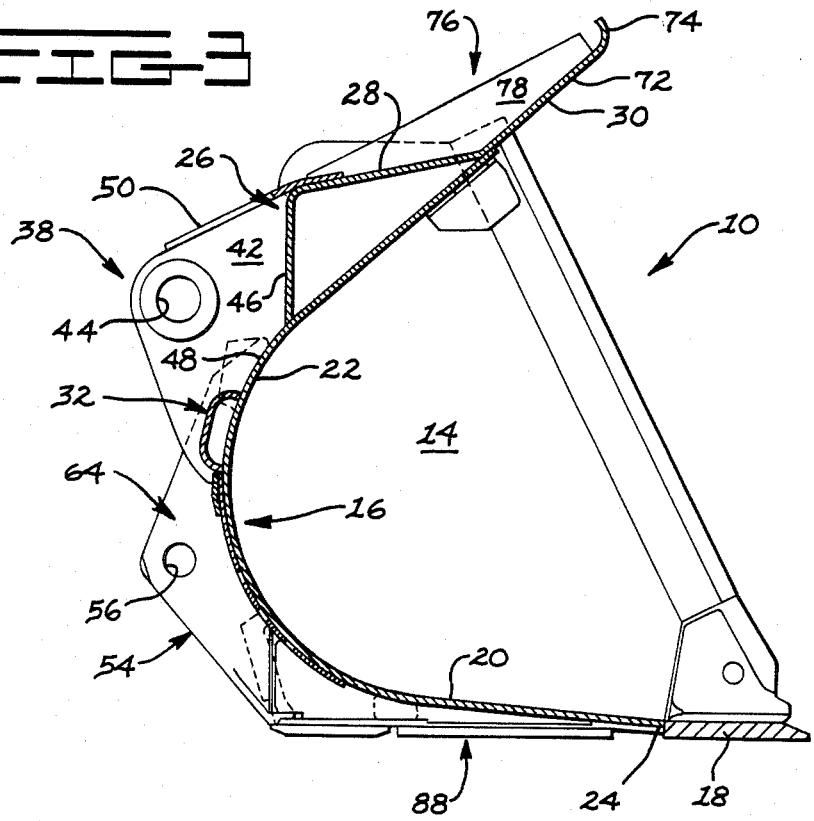
FIG. 3 is a diagrammatic sectional view of the earthmoving bucket of the present invention, taken generally along the line III—III of FIG. 2; and, FIG. 4 is a diagrammatic sectional view of a portion of the earthmoving bucket of the present invention, taken generally along the line IV—IV of FIG. 2.

Referring to the drawings, and in particular FIG. 1, a high strength earthmoving bucket 10 includes first and second end walls 12,14, a shell portion 16, and a cutting edge support 18. The shell portion 16 defines a bottom wall portion 20 and a rear wall portion 22, both of which extend laterally between the end walls 12,14. The cutting edge support 18 is connected to a forward edge 24 of the bottom wall portion, as shown in FIG. 3. The end walls 12,14, shell portion 16, and cutting edge support 18 are all connected together, as by welding, to form a basic bucket configuration.

The earthmoving bucket 10 further includes a first reinforcing beam assembly 26 which has a body portion 28 and an outwardly extending plate portion 30. The beam assembly 26 is connected to the rear wall portion 22 and extends laterally between the end walls 12,14. A second reinforcing beam assembly 32 has first and second ends 34,36 and is connected to the rear wall portion 22. The second beam assembly 32 is spaced from the first beam assembly 26 and extends substantially parallel to the first beam assembly 26. The second beam assembly 32 is spaced from and positioned centrally between the end walls 12,14.

A first bracket assembly 38 is connected to the rear wall portion 22 at a location substantially equally spaced from the end walls 12,14, and extends essentially perpendicularly between the first and second beam assemblies 26,32. The first bracket assembly 38 includes a pair of spaced parallel plates 40,42. Each of the plates 40,42 has a pin receiving bore 44, a straight edge portion 46, and a curved edge portion 48. The straight edge portion 46 is connected to the first beam assembly 26 and the curved edge portion 48 is connected to the rear wall portion 22. A U-shaped cover plate 50 spans the upper area of plates 40,42 and is connected to the plates and to the first beam assembly 26.

Figure 2:
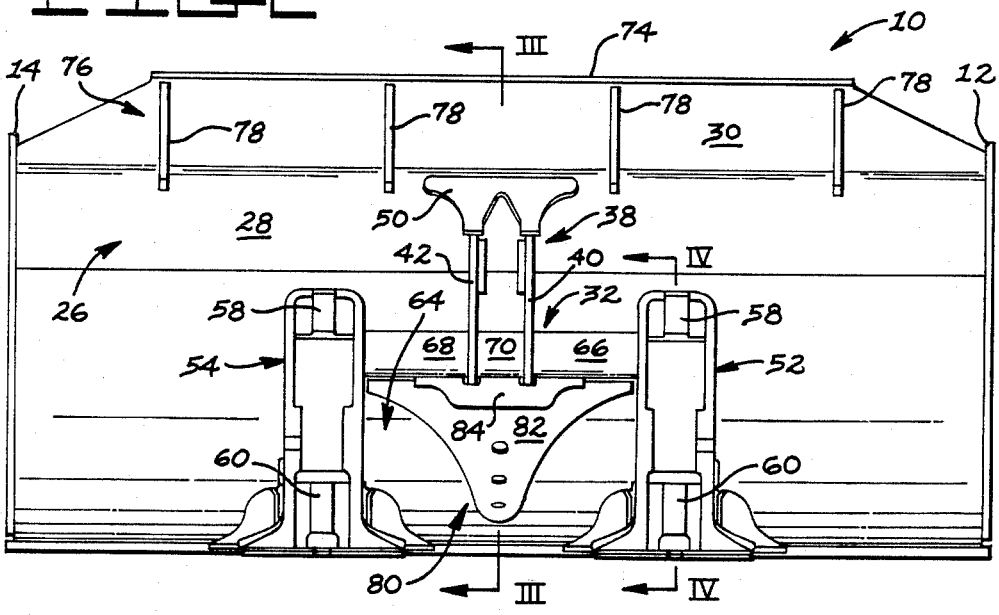
FIG. 2 is a diagrammatic rear elevational view of the earthmoving bucket of the present invention.
Figure 4:
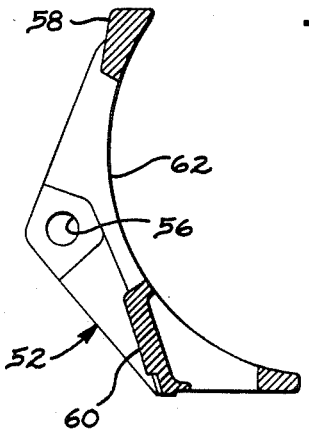

Second and third bracket assemblies 52,54 are connected to the rear wall portion 22, with the second bracket assembly 52 also being connected to the first end 34 of the second beam assembly 32, and the third bracket assembly 54 connected to the second end 36 of the second beam assembly 32. Bracket assemblies 52 and 54 are essentially similar and are preferably formed of a single unitary steel casting. Each of the bracket assemblies 52,54 has a pin connecting bore 56, a rack-back stop portion 58, and a dump-stop portion 60, as best shown in FIGS. 2 and 4. The pin connecting bore 56 in the second bracket assembly 52 is in substantially axial alignment with the pin connecting bore 56 in the third bracket assembly 54. An axis passing through the center of the bores 52 would be substantially parallel to the first beam assembly 26. Each of the bracket assemblies 52,54 has a forward curved portion 62 which mates with the profile of the rear wall portion 22.

The second and third bracket assemblies 52,54 extend beyond the second beam assembly 32 and are spaced one from the other the length of the second beam assembly 32 and define an open pocket 64. The open pocket 64 provides sufficient area for positioning a machine tool between the second and third bracket assemblies 52,54 after they are welded to the rear wall portion. Such a machine tool (not shown) can precisely bore the pin connecting bores 56 so they are in axial alignment. Precise axial alignment is important since the bores 56 are used to connect the bucket 10 to lift arms or linkages (not shown) for lifting and lowering the bucket 10. If the bores 56 of each bracket assembly 52,54 were not in alignment, the bucket 10 and/or the lifting mechanism may be strained, twisted, and damaged as the bucket is raised and lowered. The surfaces of the rack-back stops 58 and the dump stops 60 are precisely machined prior to connecting the second and third bracket assemblies 52,54 to the bucket 10. These machined surfaces are then used as locating guides when the machine tool bores the pin connecting bores 56 in each bracket 52,54.

Referring to FIGS. 1, 2, and 3, the second reinforcing beam assembly 32 includes a first beam section 66, a separate second beam section 68, and a separate third beam section 70. The first beam section 66 extends between the first and second bracket assemblies 38,52 and the second beam section 68 extends between the first and third bracket assemblies 38,54. The third beam section 70 extends between the first and second spaced plates 40,42 of the first bracket assembly 38. All three beam sections 66,68,70 are connected to the rear wall portion 22 of the bucket 10 and are also connected to adjacent bracket assemblies 38,52,54. Any loads applied to the bracket assemblies 38,52,54 are therefore transferred onto the beam assembly 32 and then onto the rear wall portion 22 of the bucket 10. Such construction spreads the loads for extended life and service of the bucket 10 and components.

As best shown in FIGS. 1 and 3, the plate portion 30 of the first reinforcing beam assembly 26 includes a flange 72 which extends above the rear wall portion 22 and defines a spill plate portion 74 of the bucket 10. A third reinforcing assembly 76 extends between, and is connected to, the body portion 28 of the first reinforcing beam assembly 26 and the flange 72. The third reinforcing assembly 76 includes a plurality of laterally spaced plates 78. This third reinforcing assembly 76 resists loads applied to the upper portion of the bucket and spreads such loads throughout the first reinforcing beam assembly 26, and then throughout the bucket 10.

In order to further strengthen the bucket 10, a fourth reinforcing assembly 80 is provided on the rear wall portion 22. As best shown in FIGS. 1 and 3, the fourth reinforcing assembly 80 includes a generally triangularly shaped plate 82 and a generally rectangularly shaped plate 84. The plate 82 has a curved profile portion which mates with the profile of the rear wall portion 22. The plate 82 is connected to the rear wall portion 22 between the second and third bracket assemblies 52,54 and below the second reinforcing beam assembly 32. The plate 84 overlays plate 82 and is connected thereto. The fourth reinforcing assembly 80 absorbs and spreads the loads applied to bracket assemblies 38,52,54.

Referring to FIGS. 1 and 3, the bucket 10 further includes a pair of bottom wear plate assemblies 86,88. These assemblies are connected to the bottom wall portion 20 and serve to strengthen and protect the bottom wall portion 20. As is especially evident from FIG. 1, the second bracket assembly 52 mates with and is connected to the wear plate assembly 86, and the third bracket assembly 54 mates with and is connected to the wear plate assembly 88.

Industrial Applicability

The subject high strength bucket 10 is particularly useful with construction and earthworking vehicles, such as wheel and track-type loading machines. Bucket loading machines are often used in mining and construction operations where the bucket is subjected to many types of wear and impact loading. In mining and construction, the buckets are used to load and transport large rocks, broken concrete, and other abrasive materials. In order to withstand such severe working conditions, a bucket must possess considerable strength and rigidity while not being overly bulky and heavy.

The subject bucket 10 is constructed to provide high impact strength and to resist severe strains and stresses from continuous loading and unloading cycles. The one piece cast bucket lifting brackets 52 and 54 contain the critical lift cylinder pin bores 56, the rack-back stops 58, and the dump limit stops 60. Since the bucket 10 is lifted, when full, through hydraulic cylinders and links which are connected to the bucket by means of the pin connecting bores 56, the entire weight of the bucket 10 and contents are applied on the cast lifting brackets 52 and 54. These brackets must be extremely strong, must be properly connected to the bucket 10, and sufficiently reinforced by complementary structure to spread the forces through the bucket structure. By forming the brackets 52 and 54 from a one piece steel casting, problems associated with fabricated bracket assemblies are eliminated.

When the bucket 10 has been filled and is ready for transport, it is tilted, or racked-back, to a carry position so the contents do not spill out. This manulation is carried out by means of hydraulic cylinder and linkage (not shown) which is connected to the bucket 10 through the pin receiving bore 44 of the bracket assembly 38. Many machines contain automatic, or semi-automatic controls which will tilt the bucket back until a stop position is reached. At this position, the rack-back stops 58 of the brackets 52 and 54 have contacted co-operating stops on the machine. Generally, such contacting of the stops is associated with a shock impact load on the bucket. This impact load is transferred onto the cast brackets 52 and 54 and then spread and dispersed through the bucket by means of the various co-operating reinforcing assemblies which have been previously described.

When the bucket is ready to be unloaded, the operator manipulates the proper controls to put the bucket in the unloading mode. As the bucket tilts forward and dumps its load, the dump limit stops 60 of each cast bracket assembly 52 and 54 contact co-operating stop members on the machine. As in the rack-back stop operation, such dump limit stop operation is generally associated with shock impact loads being applied to the brackets 52 and 54, and then onto the bucket. Often, if the bucket is being operated in wet and sticky materials, the machine operator will intentionally cycle the bucket to severely impact on the dump-limit stops to dislodge material which is sticking to the bucket. As with the previously described rack-back stops, these impact loads are transferred onto, and dispersed through the bucket 10 by way of the subject reinforcing and bracket assemblies.

The subject bucket is specifically constructed to provide a method of machining the bores 56 in the cast brackets 52 and 54 after the brackets are connected to the bucket rear wall portion 22. The method includes forming the bucket structure by connecting the side walls 12 and 14 to the bucket shell portion 16 and to the first reinforcing beam assembly 26. The first bracket assembly 38 and the second reinforcing beam assembly 32 are then connected to the rear wall portion 22 and to the first beam assembly 26. The cutting edge support 18 is connected to the forward edge 24 of the bottom wall portion 20, and the cover plate 50 is added to the first bracket assembly 38. The bottom wear plate assemblies 86 are then connected to the bottom wall portion 20 and the fourth reinforcing assembly 80 is added to the rear wall portion 22. The cast bracket assemblies 52,54 are then connected to the rear wall portion 22, the wear plate assemblies 86,88, and to the beam assembly 32. An open pocket 64 is thereby provided and a machine tool is positioned within the pocket 64. The pre-machined rack-back stops 58 and dump-limit stops 60 provide precise locating pads for the machine tool, which then machines the bores 56 in the brackets 52 and 54. Once the bores are precisely machined, the machine tool is removed and the bucket is essentially complete. It is to be understood that the above-described assembly method is given by way of example only and some variation of the assembly steps is possible without departing from the invention.

Other aspects, objects and advantages of this invention can be obtained from a study of the drawings, the disclosure, and the appended claims.

I claim:

1. In an earthmoving bucket (10) having first and second end walls (12,14), a shell portion (16) defining a bottom wall portion (20) and a rear wall portion (22) and extending laterally between said end walls (12,14), and a cutting edge support (18) secured to a forward edge (24) of said bottom wall portion (20), the improvement comprising:

a first reinforcing beam assembly (26) having a body portion (28) and an outwardly extending plate portion (30), said beam (26) being connected to said rear wall portion (22) and extending between said end walls (12,14);

a second reinforcing beam assembly (32) having first and second ends (34,36) and being connected to said rear wall portion (22), spaced from and extending parallel to said first beam assembly (26), and spaced from and positioned between said end walls (12,14);

a first bracket assembly (38) having a pin receiving bore (44) and being connected to said rear wall portion (22) at a location substantially equally spaced from said end walls (12,14) and extending between said first and second reinforcing beam assemblies (26,32);

a second bracket assembly (52) having a pin connecting bore (56), a dump-stop portion (60), and a rack-back stop portion (58) and being connected to said rear wall portion (22) and to said first end (34) of said second reinforcing beam assembly (32); and a third bracket assembly (54) having a pin connecting bore (56), a dump-stop portion (60), and a rack-back stop portion (58) and being connected to said rear wall portion (22) and to said second end (36) of said second reinforcing beam assembly (32), said second and third bracket assemblies (52,54) being spaced one from the other, extending beyond said second reinforcing beam assembly (32) and having an open pocket (64) defined by said second and third bracket assemblies (52,54), said second reinforcing beam assembly (32), and said rear wall portion (22), each of said second and third bracket assemblies (52,54) being of a unitary steel construction and being void of welds.

2. The earthmoving bucket of claim 1, wherein said first bracket assembly includes a pair of spaced parallel plates, each having a pin receiving bore, a straight edge portion, and a curved edge portion, said straight edge portion being connected to said first reinforcing beam assembly, and said curved edge portion being connected to said rear wall portion.

3. The earthmoving bucket of claim 2, wherein said second reinforcing beam assembly includes a first beam section extending between said first and second bracket assemblies, a separate second beam section extending between said first and third bracket assemblies, and a separate third beam section extending between the pair of spaced plates of said first bracket assembly.

4. The earthmoving bucket of claim 1, wherein the pin connecting bore of said second bracket assembly is in axial alignment with the pin connecting bore of said third bracket assembly and an axis passing through the center of said bores extends substantially parallel to said first reinforcing beam assembly.

5. The earthmoving bucket of claim 1, wherein said plate portion of said first reinforcing beam assembly has a flange extending above said rear wall portion and defining a spill plate portion of said bucket.

6. The earthmoving bucket of claim 5, including a third reinforcing assembly extending between said body portion and said flange and being connected to said body portion and said plate portion.

7. The earthmoving bucket of claim 6, wherein said third reinforcing assembly includes a plurality of laterally spaced plates.

8. The earthmoving bucket of claim 1, including a fourth reinforcing assembly having a curved profile portion mating with the profile of said rear wall portion and being connected to said rear wall portion between said second and third bracket assemblies.

9. The earthmoving bucket of claim 8, wherein said fourth reinforcing assembly includes a generally triangularly shaped plate and a generally rectangularly shaped plate overlaying and connected to said triangularly shaped plate.

* * * * *